US005243251A

United States Patent [19]

Inukai et al.

[11] Patent Number: 5,243,251

[45] Date of Patent: Sep. 7, 1993

[54] LAMP HAVING A GLASS ENVELOPE WITH FLUOROCARBON POLYMER LAYER

[75] Inventors: Shinji Inukai, Yokohama; Satoshi Iwasawa; Kazuo Takita, both of Yokosuka; Katsusuke Uchino, Yokohama, all of Japan

[73] Assignee: Toshiba Lighting & Technology Corporation, Tokyo, Japan

[21] Appl. No.: 961,022

[22] Filed: Oct. 14, 1992

Related U.S. Application Data

[63] Continuation of Ser. No. 683,170, Apr. 10, 1991, abandoned.

[30] Foreign Application Priority Data

Apr. 13, 1990 [JP] Japan ..... 2-096311
Nov. 5, 1990 [JP] Japan ..... 2-297176

[51] Int. Cl.[5] ..... H01J 61/35; H01J 61/42; H01J 61/34

[52] U.S. Cl. ..... 313/25; 313/493; 313/635

[58] Field of Search ..... 313/25, 493, 635, 377

[56] References Cited

U.S. PATENT DOCUMENTS

| | | | |
|---|---|---|---|
| 3,969,547 | 7/1976 | Isawa et al. . | |
| 4,048,537 | 9/1977 | Blaisdell et al. | 313/493 X |
| 4,804,886 | 2/1989 | Nolan et al. | 313/635 X |
| 4,888,517 | 12/1989 | Keeffe et al. | 313/635 X |
| 5,021,710 | 6/1991 | Nolan | 313/635 X |
| 5,034,650 | 7/1991 | Nolan | 313/493 X |

FOREIGN PATENT DOCUMENTS

| | | | |
|---|---|---|---|
| 0175333 | 3/1986 | European Pat. Off. . | |
| 0181197 | 5/1986 | European Pat. Off. . | |
| 0342721 | 11/1989 | European Pat. Off. . | |
| 71546 | 4/1985 | Japan . | |
| 21855 | 1/1989 | Japan . | |
| 24954 | 1/1990 | Japan | 313/635 |
| 72553 | 3/1990 | Japan | 313/635 |

OTHER PUBLICATIONS

Patent Abstracts of Japan, unexamined applications, c field, vol. 9, No. 205, Aug. 22, 1985, The Patent Office Japanese Government, Abstract entitled "Process for Coating Fluorine-Containing Resin Film on External Surface of Glass Sphere," 60-71546, p. 38C299.

*Primary Examiner*—Palmer C. DeMeo
*Attorney, Agent, or Firm*—Cushman, Darby & Cushman

[57] ABSTRACT

This invention provides an improved layer coated on the outer surface of the envelope of high intensity discharge lamps, halogen lamps and so on. The overcoated layer is provided for preventing glass pieces of the envelope from scattering when the glass envelope is broken. Therefore the improved and strengthened layer comprises a fluorocarbon polymer containing metal oxide grains dispersed therein. The metal oxide grains are dispersed in the fluorocarbon polymer since the overcoated layer is heated at more than 200° C. Further, for the purpose of strengthening the overcoated layer, the overcoated layer has an even density of the metal oxide grains in the fluorocarbon polymer. The even density of the metal oxide grains in the fluorocarbon polymer is obtained only by this invention of the coating method that includes a electrostatic coating step.

16 Claims, 4 Drawing Sheets

LAMP HAVING A GLASS ENVELOPE WITH FLUOROCARBON POLYMER LAYER

This is a continuation of application Ser. No. 07/683,170, filed on Apr. 10, 1991, which was abandoned upon the filing hereof.

BACKGROUND OF THE INVENTION

1. Field of the invention

The present invention relates to a lamp having a layer, which is made of fluorocarbon polymer, coated on an envelope thereof, and also relates to a method for forming the layer.

2. Description of the related art

A lamp having a layer, which is made of fluorocarbon polymer, coated on a glass envelope of the lamp is known in this field. The layer is formed so as to prevent glass pieces of the glass envelope from scattering when the glass envelope of the lamp is broken. The fluorocarbon polymer is used as a material of the layer since the fluorocarbon polymer has a high melting temperature. Therefore, the layer of the fluorocarbon polymer is adapted especially to high intensity discharge lamps such as metal halide lamps whose outer envelopes have high temperature of more than 200° C.

However, the conventional layer of the fluorocarbon polymer is not sufficient in its strength for high intensity discharge lamps. Therefore there is a demand to increase the strength of the layer of the fluorocarbon polymer on the outer glass envelope of the high intensity discharge lamp.

A strengthened layer of the fluorocarbon polymer is obtained by way of increasing the thickness of the layer of the fluorocarbon polymer. However, in this case the lamp has a shortcoming in that the luminous flux of the lamp emitted from the outer glass envelope of the lamp decreases, because of light absorption by the layer of the fluorocarbon polymer.

Further lamps having an improved layer of the fluorocarbon polymer are shown in the Japanese Patent Laid Open Publications No. 60-71546 and No. 64-21855. The lamp shown in the 60-71546 publication has a layer of fluorocarbon polymer containing glass fibers. But the glass fibers are mixed into the fluorocarbon polymer for increasing the adhesive strength between the layer of the fluorocarbon polymer and the outer glass envelope of the lamp, and not for increasing the strength of the layer of the fluorocarbon polymer itself, in other words not for tensile strength. The layer of the fluorocarbon polymer of this lamp is not improved in its tensile strength.

The lamp shown in the 64-21855 publication has an under layer between the layer of the fluorocarbon polymer and the outer glass envelope of the lamp. The under layer is generally called a primer layer. The under layer shown in the 64-21855 publication contains metal oxide grains dispersed therein and is coated for the same reason as the glass fibers mixed into the fluorocarbon polymer. The layer of the fluorocarbon polymer of this lamp is not improved in its strength.

SUMMARY OF THE INVENTION

Accordingly, it is an object of the present invention to provide a strengthened layer of fluorocarbon polymer coated on the outer envelope of the lamp and to provide a method for manufacturing thereof.

In order to achieve the above mentioned object, the lamp according to the present invention comprises:

means for emitting light and heat;

an envelope including said means and heated at more than 200° C. by said means; and A first layer coated on an outside of said envelope, said first layer comprising a fluorocarbon polymer containing metal oxide grains dispersed therein.

DETAILED DESCRIPTION OF THE PREFERRED EMBODIMENTS

Figure 1:
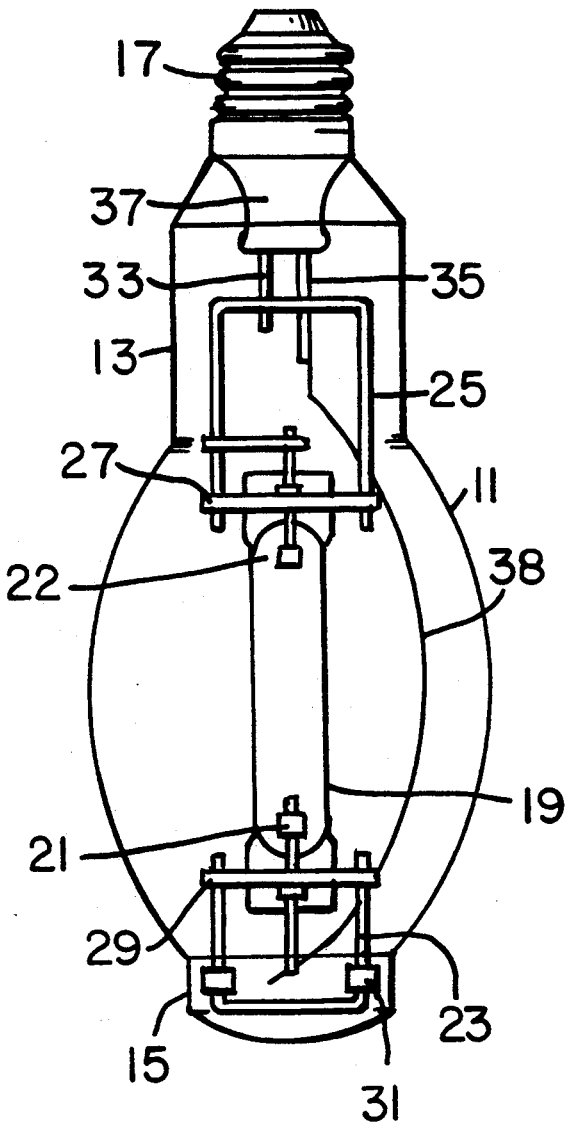
FIG. 1 is a front view of a metal halide lamp according to a first embodiment of the present invention.

Referring to the accompanying drawings, embodiments of the present invention will be described. However, in the drawings, the same numerals are applied to the similar elements in the drawings, and therefore the detailed descriptions thereof are not repeated.

FIG. 1 is a front view of a metal halide lamp according to the first embodiment of the present invention.

The metal halide lamp has an outer envelope 11 made of hard glass. The outer envelope 11 forms a shape, so called BT-shape, swelling around a center thereof and forms thin portions at both ends of the outer envelope 11 as compared with a portion around the center of the outer envelope 11. One of the thin portions is a neck portion 13 and the other is a top portion 15. The neck portion 13 has a base 17 for attaching the lamp to lighting equipment (not shown) and for receiving electric power.

The outer envelope 11 includes a inner tube 19 therein. The inner tube 19 is made of quartz glass. A pair of electrodes 21 and 22 are provided at both ends in the inner tube 19. A rare gas as a starting gas such as argon and a discharge gas such as mercury, sodium halide and scandium halide are sealed in the inner tube 19.

The inner tube 19 is supported in the outer envelope 11 by a pair of supporting wires 23 and 25 and a pair of insulated holders 27 and 29. The one supporting wire 23 is fixed by elastic members 31 and 31 at the top portion 15 and the other supporting wire 25 is connected with and supported by the lead wire 33 which is mounted to a stem portion 37. The electrode 21 is connected electrically with the other lead wire 35 through a connecting wire 38. The other electrode 22 is connected electrically with the other supporting wire 25. Both of the lead wires 33 and 35 are connected electrically with the base 17. Accordingly, both of electrodes 21 and 22 are connected electrically with the base 17.

Figure 2:
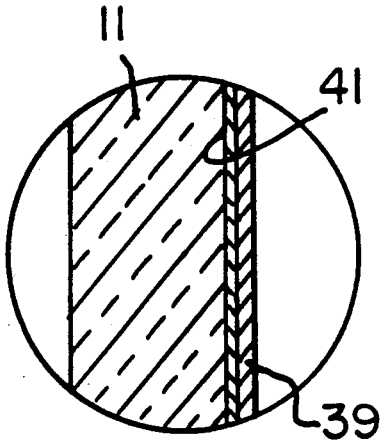
FIG. 2 is a partial sectional view of FIG. 1.

An overcoated layer 39 is coated on the outside of the outer glass envelope 11 shown in FIG. 2 which indicates a partial sectional view of the outer glass envelope 11 of the lamp. The overcoated layer 39 essentially consists of fluorocarbon polymer containing metal oxide grains (not shown) dispersed therein and has a thickness of about 100 μm. An undercoated layer 41 is formed between the overcoated layer 39 and the outer surface of the outer glass envelope 11.

The fluorocarbon polymer of this embodiment essentially consists of tetrafluoroethylene-perfluoroalkylvinylether copolymer (called PFA) (MP-103: available from MITSUI DUPONT FLUOROCHEMICAL CO., LTD in Japan), but other fluorocarbon polymers, for example tetrafluoroethylene-hexafluoropropylene copolymer (called FEP), tetrafluoroethylene-hexafluoropropylene-perfluoroalkylvinylether copolymer (called EPE) (available from MITSUI DUPONT FLUOROCHEMICAL CO., LTD in Japan) and so on, may be used. The metal oxide grains of this embodiment consist of zinc oxide (ZnO) (available from SUMITOMO SEMENTO CO., LTD in Japan) and titanium oxide ($TiO_2$) (available from SUMITOMO SEMENTO CO., LTD in Japan), but other metal oxide, for example tantalum oxide ($Ta_2O_5$), silicon oxide ($SiO_2$), aluminum oxide ($Al_2O_3$) and so on, may be used. The weight of metal oxide grains is 1% of weight of fluorocarbon polymer. An average of particle size of grains of zinc oxide (ZnO) and titanium oxide ($TiO_2$) is about 0.02 μm, and the weight of zinc oxide (ZnO) and the weight of titanium oxide ($TiO_2$) are the same as each other.

The undercoated layer 41 is formed by coating a mixed agent, generally called a primer, of a nonionic surface active agent (458-500: available from MITSUI DUPONT FLUOROCHEMICAL CO., LTD in Japan), a certain amount of silicon oxide ($SiO_2$) grains and aluminium oxide ($Al_2O_3$) grains on the outer surface of the outer glass envelope 11 and drying the coated agent. It is necessary to eliminate fats and oils from the outer surface of the outer glass envelope 11, for example, by washing or baking before coating the mixed agent.

After coating the undercoated layer 41, the overcoated layer 39 is formed by steps including a well known electrostatic coating method. The first step is preparing a mixed powder containing the powder of the fluorocarbon polymer, the powder of zinc oxide (ZnO) grains and the powder of titanium oxide ($TiO_2$) grains. The detail of each powder is described above. The next step is coating the mixed powder on the surface of the undercoated layer 41 in an area of the undercoated layer 41 by the electrostatic coating method. In this case, the undercoated layer 41 works as a electrode attracting charged particles of powder. Therefore, the overcoated layer 39 is formed only on the undercoated layer 41. The next step is heating the powder coated on the surface of the outer glass envelope 11 at the temperature from 310° C. to 400° C. in order that the powder of the fluorocarbon polymer melts and forms a continuous layer of the fluorocarbon polymer, i.e. the overcoated layer 39. As is understood from the above description, the undercoated layer 41 is coated not only in order to increase the adhensive strength of the overcoated layer 39 with respect to the outer surface of the outer glass envelope 11 but also in order to form the overcoated layer 39.

According to the above described method, the overcoated layer 39 has an even density of the metal oxide grains at any position thereof because the above described method does not use liquid, and is not wet coating. Therefore the metal oxide grains do not condense unevenly during forming of the overcoated layer 39. In other words, the above described method does not have the disadvantage that the metal oxide grains would condense at one side of the envelope during drying of the coating liquid because of the effect of gravity. Moreover the overcoated layer 39 has an even thickness at any position thereof since the above described method does not use liquid and therefore does not have the defect that coating liquid would flow and drop toward one side of the envelope during the step for drying the coating liquid.

Figure 3:
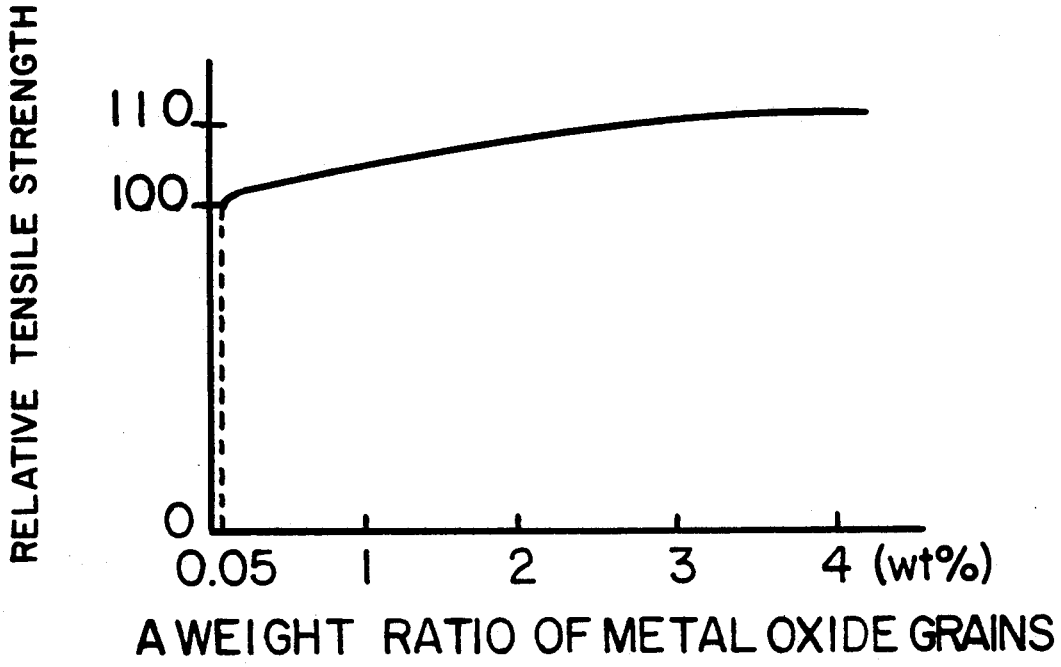
FIG. 3 is a graph for explaining a relation between tensile strength of the overcoated layer of the lamps and the weight ratio of the metal oxide grains dispersed in the overcoated layer.

FIG. 3 shows measured results of tensile strength of the overcoated layer 39 of the lamps when the weight ratio of the metal oxide grains dispersed in the overcoated layer 39 is varied. In FIG. 3, a horizontal axis indicates the weight ratio of the metal oxide grains and a vertical axis indicates relative value of the tensile strength of the overcoated layer 39, and 100% means the tensile strength in case of the overcoated layer 39 without the metal oxide grains. As described above, an average particle size of the metal oxide grains is 0.02 μm and the thickness of the overcoated layer 39 is about 100 μm.

According to the measured results of FIG. 3, the tensile strength increased, accompanied by the increase of the weight ratio of the metal oxide grains in the range of more than 0.05% of the metal oxide grains.

The reason why the tensile strength increased is thought to be that the metal oxide grains dispersed between overlaped fluorocarbon polymer molecules of the overcoated layer 39 prevent slipping between fluorocarbon polymer molecules. Moreover, the following is supposed. As the overcoated layer 39 formed by the above described method has the even density of the metal oxide grains at any position thereof and there is no position that has extremely low density of the metal oxide grains, there is no position that has an extremely weak tensile strength as compared with other positions. It is supposed that the tensile strength increased because of the above described reason.

Similar results were obtained in cases of other kinds of metal oxide grains and different particle sizes.

Figure 4:
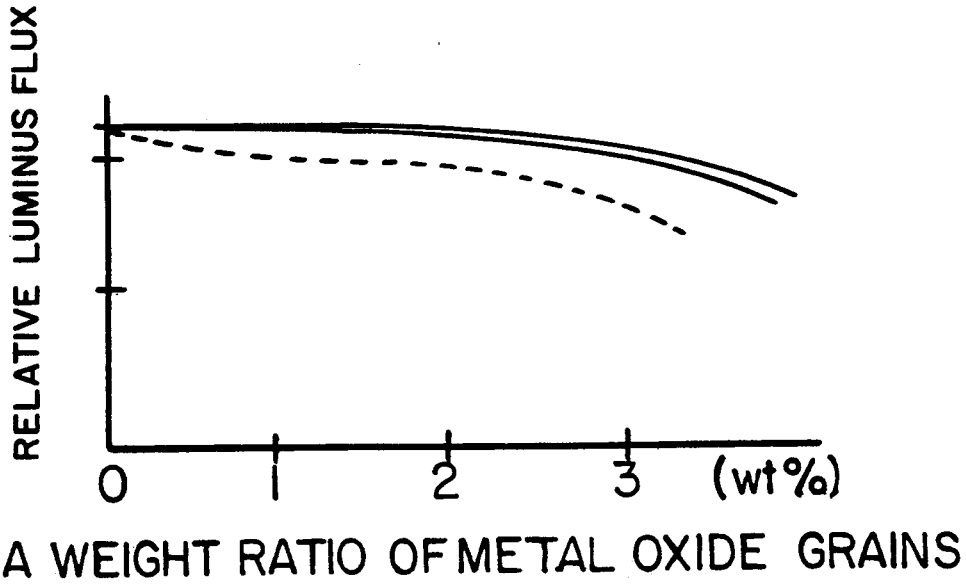
FIG. 4 is a graph for explaining a relation between luminus flux of the lamps and the weight ratio of the metal oxide grains dispersed in the overcoated layer.

FIG. 4 shows measured results of luminous flux of the lamps, varing the weight ratio and the average particle size of the metal oxide grains dispersed in the overcoated layer 39. In FIG. 4, a horizontal axis indicates the weight ratio of the metal oxide grains and a vertical axis indicates relative value of the luminous flux of the lamps, and 100% means the luminous flux of the lamps in case that the overcoated layer 39 does not have the metal oxide grains. The three lines (a), (b) and (c) correspond to the average particle size of 0.02 μm, 0.1 μm and 0.2 μm respectively.

According to the measured results of FIG. 4, the luminous flux decreased, accompanied by the increase of the weight ratio of the metal oxide grains. This indicates that the metal oxide grains of the overcoated layer 39 absorbs the light. In this case, the decrease of the luminous flux was not so much within the range of 3% of the weight ratio of the metal oxide grains, but it was too much beyond the range of 3% of the weight ratio of the metal oxide grains. It is also understood that the decrease of the luminous flux was too much when the particle size was more than 0.1 μm even if the weight ratio of the metal oxide grains was small. When the weight ratio of the metal oxide grains is too much, the overcoated layer 39 has a defect of opacity or untransparency.

Similar results were obtained in cases of other kinds of metal oxide grains.

Accordingly, the preferable range of the particle size of the metal oxide grains was determined to be not more than 0.1 μm and the preferable range of the weight ratio of the metal oxide grains was determined to be from 0.05 to 3%.

Figure 5:
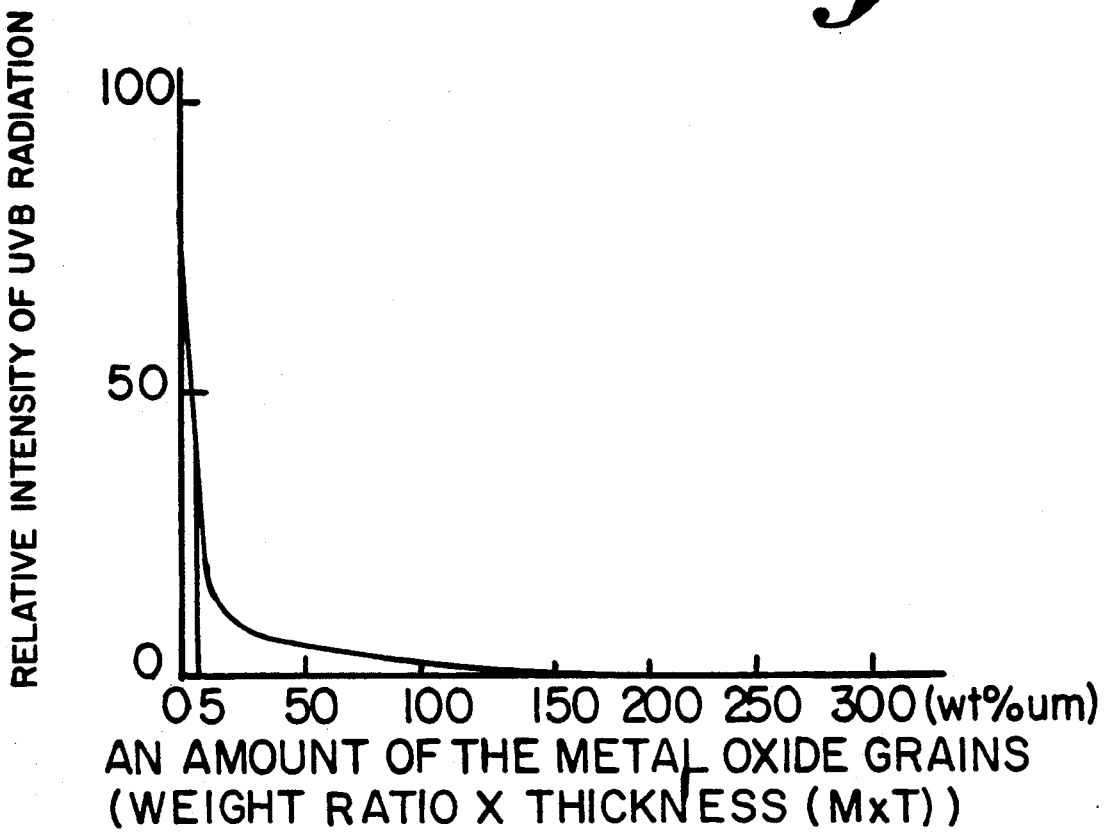
FIG. 5 is a graph for explaining a relation between intensity of UVB emitted from the lamps and an amount of the metal oxide grains dispersed in the overcoated layer.

FIG. 5 shows measured results of intensity of ultraviolet rays emitted from the lamps, varing the weight ratio (M wt %) of the metal oxide grains dispersed in the overcoated layer 39 and the thickness (t μm) of the overcoated layer 39. The metal oxide grains of the lamps consist of titanium oxide ($TiO_2$) and zinc oxide (ZnO) as described above. The ultraviolet rays having wavelength of 280–320 nm, which is called UVB, was measured. In FIG. 5, a horizontal axis indicates an amount (Mxt) of the metal oxide grains dispersed in the overcoated layer 39. The amount (M×t) of the metal oxide grains dispersed in the overcoated layer 39 is defined as a multiplied value between the weight ratio (M) of the metal oxide grains and the thickness (t) of the overcoated layer 39. A vertical axis indicates relative intensity of UVB emitted from the lamps and 100% means the intensity of UVB in case that the overcoated layer 39 does not contain the metal oxide grains.

As shown in FIG. 5, the intensity of UVB emitted from the lamp decreased, accompanied by the increase of the weight ratio (M) of the metal oxide grains and the thickness (t) of the overcoated layer 39. Especially, the intensity of UVB emitted from the lamp which has, as described above, 100 μm thickness of the overcoated layer 39 containing 1% weight of the metal oxide grains of titanium oxide ($TiO_2$) and zinc oxide (ZnO) decreases under a hundredth as much as the intensity of UVB emitted from the lamp having the overcoated layer 39 not containing the metal oxide grains. Further, the intensity of UVB emitted from the lamp which has 5 wt % μm (=M×t) of the amount of the metal oxide grains is a half of the intensity of UVB emitted from the lamp having the overcoated layer 39 not containing the metal oxide grains. In general, it is understood that the effect of suppressing fading is obtained by decreasing the intensity of the UVB by a half. Therefore, the preferable lamps have more than 5 wt % μm (=M×t) of the amount of the metal oxide grains in order to suppress fading. Similar results were obtained with regard to the lamps which have the overcoated layer 39 containing different particle sizes of the metal oxide grains, and were also obtained with regard to the lamps which have the overcoated layer 39 containing different kinds of the metal oxide grains such as only titanium oxide ($TiO_2$), only zinc oxide (ZnO) or a mixture of cerium oxide (CeO).

Figure 6:
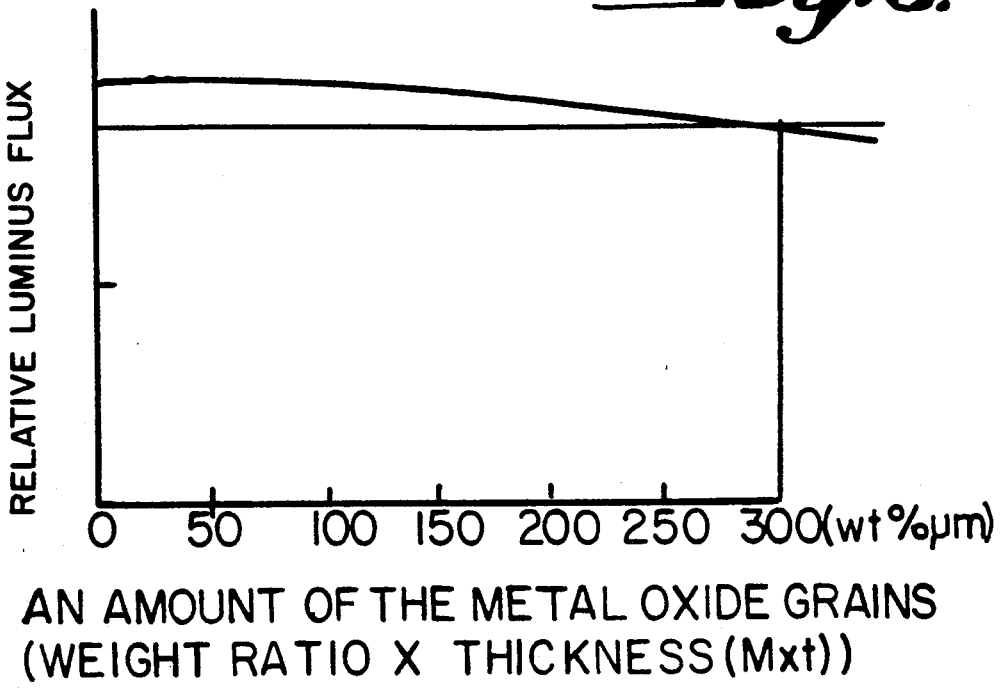
FIG. 6 is a graph for explaining a relation between luminus flux of the lamps and an amount of the metal oxide grains dispersed in the overcoated layer.

FIG. 6 shows the relation between luminous flux of the lamp and the amount (M×t) of the metal oxide grains. In FIG. 6, a horizontal axis indicates the amount (M×t) of the metal oxide grains and a vertical axis indicates relative value of the luminous flux of the lamp, and 100% means the luminous flux of the lamp whose overcoated layer 39 does not have the metal oxide grains, or 100% means the luminous flux of the lamp which does not have the overcoated layer 39. FIG. 6 was obtained under the condition that the metal oxide grains consists of the same amounts of titanium oxide ($TiO_2$) and zinc oxide (ZnO) which had an average particle size of about 0.02 μm and that the overcoated layer 39 had the thickness of about 100 μm.

As shown in FIG. 6, the intensity of the luminous flux emitted from the lamp decreased, accompanied by the increase of the weight ratio (M) of the metal oxide grains and the thickness (t) of the overcoated layer 39. These results coincide with the measured results regarding to FIG. 4. In this case, the decrease of the luminous flux was not so much within 300 (wt %×μm) of the amount of the metal oxide grains, but it was too much beyond 300 (wt %×μm) of the amount of the metal oxide grains. Further the overcoated layer 39 has a defect of opacity or untransparency in case that the amount (M×t) of the metal oxide grains is beyond 300 (wt %×μm), the same as the results according to FIG. 4.

Similar results were obtained in case of other kinds of metal oxide grains and in case of different particle sizes of the metal oxide grains.

According to the measured results regarding to FIG. 5 and FIG. 6, the preferable amount of the metal oxide grains is following.

$$5 \leqq M \times t \leqq 300$$

Figure 7:
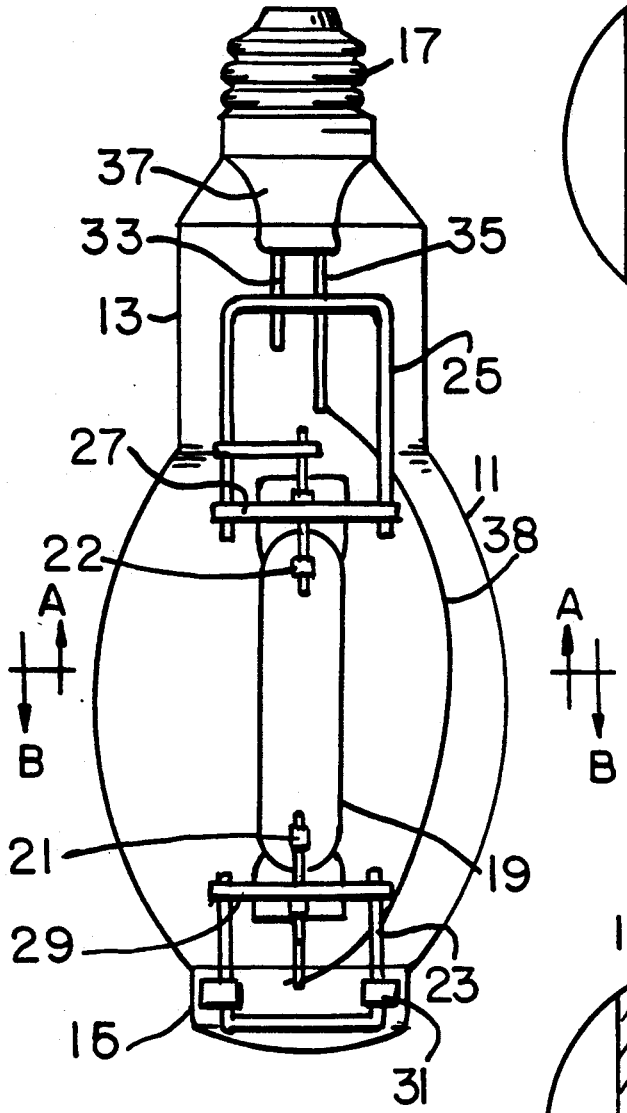
FIG. 7 is a front view of a metal halide lamp according to a second embodiment of the present invention.
Figure 8:
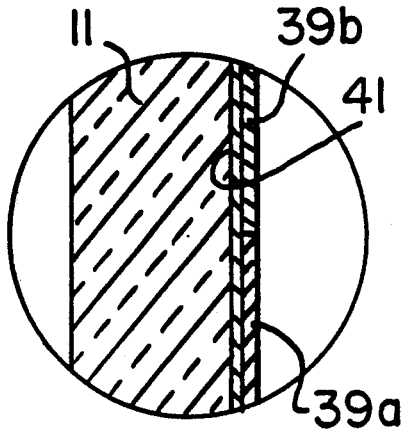
FIG. 8 is a partial sectional view of FIG. 7.

FIG. 7 and FIG. 8 show a second embodiment of the present invention. In the drawings, the same numerals are applied to the similar elements to the first embodiment, and therefore the detailed descriptions thereof are not repeated.

The weight ratio (or density) of the metal oxide grains of the overcoated layer 39 of the lamp of this embodiment varies according to positions of the overcoated layer 39. This is the only difference between the lamp of this embodiment and the lamp of the first embodiment. The weight ratio of the metal oxide grains of the overcoated layer **39*a* is 0.75 wt % at the top side area A of the lamp including the top portion 15 of the envelope 11, and the weight ratio of the metal oxide grains of the overcoated layer 39*b* is 1 wt % at the base side area B of the lamp including the neck portion 13 of the envelope 11. A boundary between the top side area A and the area base side B is positioned at the thickest portion of the envelope 11. The thickness of the overcoated layer 39** is 100 μm on both sides, as in the first embodiment. The other elements of this embodiment are the same as the first embodiment.

The lamp having two kinds of overcoated layers is obtained by preparing two kinds of coating mixtures having different weight ratios of the metal oxide grains each other and by coating each mixture on the specific area of the envelope 11 in two steps.

It was found that the metal oxide grains dispersed in the overcoated layer 39 disturbed radiation of heat from the lamp. Considering this fact, it is preferred that the weight ratio (or density) of the metal oxide grains at the portion of the envelope 11 tending to have high temperature be lower than that at the portion of the envelope 11 tending to have low temperature. Generally, these kinds of lamps, having a single base, are apt to be attached to lighting equipment for operating in a position that the base is upward, and accordingly the top side area A of the envelope 11 tends to have high temperature. Therefore, the weight ratio of the metal oxide grains at the top area A of the envelope 11 is lower than that at the base area B of the envelope 11, so as to radiate heat effectively from the lamp.

Figure 9:
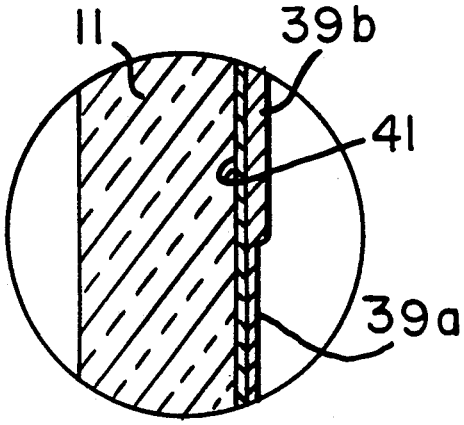
FIG. 9 is a partial sectional view of a third embodiment of the present invention.

As shown in FIG. 9, instead of varying the weight ratio of the metal oxide grains according to the area of the envelope 11, it may be possible to varying the thickness of the overcoated layer 39 according to the top area A and the base area B, keeping a set value of the weight ratio of the metal oxide grains in both areas. In this case, thickness of the overcoated layer 39*a* at the top area A of the envelope 11 is thinner than that of the overcoated layer 39*b* at the base area B of the envelope 11.

The present invention may be applied not only to the metal halide lamps described above, but also to high intensity discharge lamps such as high pressure sodium lamps, high pressure mercury discharge lamps and so on. Further, the present invention may be applied to halogen lamps. In this case, a tungsten filament emits light and heats an envelope, which is usually made from quartz glass, at more than 200° C. Therefore the present invention is also suitable for the halogen lamps.

In summary, it will be seen that the present invention overcomes the disadvantages of the prior art and provides an improved layer for preventing glass pieces from scattering when the glass envelope of the lamp is broken. Many changes and modifications in the above described embodiments can thus be carried out without departing from the scope of the present invention. Therefore, the appended claims should be construed to include all such modifications.

What is claimed is:

1. A lamp comprising:

means for emitting light and heat;

a glass envelope surrounding said means and heated at more than 200° C. by said means; and a first layer, coated on the outside of said envelope; said layer comprising a fluorocarbon polymer containing metal oxide grains dispersed therein.

2. A lamp according to claim 1, wherein said metal oxide grains are selected from the group consisting of $TiO_2$, $ZnO_2$, $SiO_2$, $Ta_2O_5$, $Al_2O_3$ and CeO.

3. A lamp according to claim 1, wherein an average particle size of said metal oxide grains is not more than 0.1 μm

4. A lamp according to claim 3, wherein a weight ratio of said metal oxide grains to fluorocarbon polymer is from 0.05% to 3%.

5. A lamp according to claim 1, wherein said means emits ultraviolet rays and said metal oxide grains suppress said ultraviolet rays.

6. A lamp according to claim 5, wherein said metal oxide grains are selected from the group consisting of $TiO_2$, ZnO and CeO.

7. A lamp according to claim 6, wherein a weight ratio (M,wt %) of said metal oxide grains and a thickness (t,μm) of said overcoated layer satisfy the following relation:

$$5 \leq M \times t \leq 300.$$

8. A lamp according to claim 1, further comprising a second layer formed between said envelope and said first layer for increasing the adhesive strength of said first layer to said envelope.

9. A lamp according to claim 1, wherein said light emitting means comprises an inner tube, wherein said inner tube contains;

i) a discharge gas and, ii) a pair of electrodes, so as to emit light and heat generated by a discharge of said discharge gas.

10. A lamp according to claim 1, wherein said first layer has a plurality of portions of varying thickness.

11. A lamp according to claim 10, wherein said first layer has a thick portion and a thin portion, as compared with each other.

12. A lamp according to claim 11, further comprising a base, attached to a position of said envelope corresponding to said thick portion of said first layer, so as to obtain electric power and to supply said electric power to said means.

13. A lamp according to claim 1, wherein said first layer has a plurality of portions wherein the weight ratio of said metal oxide grains contained in said first layer varies.

14. A lamp according to claim 13, wherein said first layer has a high weight ratio portion and a low weight ratio portion of said metal oxide grains, as compared with each other.

15. A lamp according to claim 14, further comprising a base, attached to a position of said envelope corresponding to said high weight ratio portion of said first layer, so as to obtain electric power and to supply said electric power to said means.

16. A high intensity gas discharge lamp comprising:

i) a light emitting means having an inner tube, wherein said tube contains;

a discharge gas; and, a pair of electrodes disposed in said inner tube, so as to emit light and heat generated by a discharge of said discharge gas;

ii) a glass envelope surrounding said light emitting tube and heated at more than 200° C. by said light emitting tube; and, iii) a first layer, coated on the outside of said envelope, said layer comprising a fluorocarbon polymer containing metal oxide grains dispersed therein.

* * * * *